US010702967B2

(12) United States Patent
Sung et al.

(10) Patent No.: US 10,702,967 B2
(45) Date of Patent: Jul. 7, 2020

(54) METAL PLATE, PATTERNING APPARATUS AND PATTERNING METHOD USING THE SAME

(71) Applicant: Samsung Electronics Co., Ltd., Suwon-si, Gyeonggi-do (KR)

(72) Inventors: Do Soo Sung, Suwon-si (KR); Sung Wook Kim, Suwon-si (KR); Jin O Kwak, Suwon-si (KR); Young Tae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 111 days.

(21) Appl. No.: 15/852,901

(22) Filed: Dec. 22, 2017

(65) Prior Publication Data

US 2018/0178344 A1 Jun. 28, 2018

(30) Foreign Application Priority Data

Dec. 22, 2016 (KR) ..... 10-2016-0176284

(51) Int. Cl.

| | |
|---|---|
| ***B24B 21/04*** | (2006.01) |
| ***B24B 27/00*** | (2006.01) |
| ***B24B 21/00*** | (2006.01) |
| ***B44C 1/22*** | (2006.01) |
| ***B24B 19/02*** | (2006.01) |
| ***B24B 21/12*** | (2006.01) |
| ***B24D 11/04*** | (2006.01) |
| ***B44C 5/04*** | (2006.01) |
| *A47B 96/20* | (2006.01) |

(52) U.S. Cl.

CPC ..... *B24B 21/04* (2013.01); *B24B 19/02* (2013.01); *B24B 21/008* (2013.01); *B24B 21/12* (2013.01); *B24B 27/0076* (2013.01); *B24D 11/04* (2013.01); *B44C 1/222* (2013.01); *B44C 5/0415* (2013.01); *A47B 2096/208* (2013.01)

(58) Field of Classification Search

CPC ..... B24B 21/04; B24B 19/02; B24B 21/008; B24B 21/12; B24B 27/0076; B24B 11/04; B44C 1/222; B44C 5/0415

USPC ..... 451/57, 309

See application file for complete search history.

(56) References Cited

U.S. PATENT DOCUMENTS 2,791,070 A * 5/1957 Schaller ..... B24B 21/12 451/300
2,904,937 A * 9/1959 Feurich ..... B24B 21/00 451/303

(Continued)

FOREIGN PATENT DOCUMENTS

JP 2012-200742 A 10/2012
KR 10-1284225 B1 7/2013

(Continued)

*Primary Examiner* — George B Nguyen

(57) ABSTRACT

Disclosed herein are a metal plate including a plurality of pattern portions, a patterning apparatus configured to form a plurality of patterns on the metal plate, and a patterning method using the same. The metal plate to be used in a household appliance includes a plurality of pattern portions in which a hairline pattern is formed on a surface of the metal plate, wherein the plurality of pattern portions includes a first pattern portion having a first hairline pattern and a second pattern portion having a second hairline pattern different from the first hairline pattern.

8 Claims, 9 Drawing Sheets

(56) References Cited

U.S. PATENT DOCUMENTS

| | | | | | |
|---|---|---|---|---|---|
| 2,946,163 | A * | 7/1960 | James | B24B 21/12 | 451/537 |
| 3,125,461 | A * | 3/1964 | Hoffmann | B24B 21/12 | 427/289 |
| 4,084,356 | A * | 4/1978 | Brears | B24B 21/00 | 144/355 |
| 6,629,875 | B2 * | 10/2003 | Steere, III | B24B 9/065 | 451/297 |
| 7,101,270 | B2 * | 9/2006 | Bau' | B24B 7/06 | 451/271 |
| 9,718,210 | B1 * | 8/2017 | Sazhin | A01K 31/12 | |
| 2012/0295522 | A1 * | 11/2012 | Boggs | B24B 21/006 | 451/59 |

FOREIGN PATENT DOCUMENTS

| | | | |
|---|---|---|---|
| KR | 10-1573371 | B1 | 12/2015 |
| KR | 10-2017-0027059 | A | 3/2017 |

* cited by examiner

500

METAL PLATE, PATTERNING APPARATUS AND PATTERNING METHOD USING THE SAME

CROSS-REFERENCE TO RELATED APPLICATION AND CLAIM OF PRIORITY

This application is related to and claims priority to Korean Patent Application No. 10-2016-0176284, filed on Dec. 22, 2016, the contents of which are incorporated herein by reference.

TECHNICAL FIELD

Embodiments of the present disclosure relate to a metal plate including a plurality of pattern portions, a patterning apparatus for forming a plurality of patterns on the metal plate, and a patterning method using the same.

BACKGROUND

Generally, a metal plate is used to form exteriors of various household appliances such as a refrigerator, a washing machine, a dish washer, an oven, and so on.

A type of the metal plate capable of forming the exterior of the household appliance may be appropriately selected according to an application. The type of the metal plate may include aluminum or an alloy thereof, copper or an alloy thereof, steel or an alloy thereof, zinc or tin-coated aluminum, copper or steel, a zinc or tin alloy, stainless steel, and so on.

Currently, in competition between companies developing the household appliances, designs and sizes of the household appliances may serve as a major factor in selecting the household appliances.

In particular, a surface of the metal plate capable of forming the exterior of the household appliance may be designed differently by forming various patterns thereon through a surface treatment to have beautiful exteriors.

Generally, the surface treatment of the metal plate may prevent glare caused by a specific gloss of metal generated on the surface of the metal plate and may enhance the quality of the household appliance.

Such a surface treatment method may include a hairline patterning method corresponding to one aspect of a design competition of the household appliances. The hairline patterning method may correspond to a method of forming a hairline pattern which is a line formed continuously and long like a hair on the surface of the metal plate.

The hairline pattern formed to have uniform density and thickness may increase a design value of the household appliance.

Generally, a hairline process forming the hairline pattern may correspond to a method of forming a directional streak on the surface of the metal plate by a mechanical method to leave an abrasive mark continuously on the surface of the metal plate using an abrasive and finishing the surface treatment.

SUMMARY

To address the above-discussed deficiencies, it is a primary object to provide a metal plate improved to have various hairline patterns formed on a surface thereof, a patterning apparatus, and a patterning method using the same.

Also, it is another aspect of the present disclosure to provide a metal plate improved to be capable of forming a plurality of hairline patterns and various patterns other than the hairline patterns on a surface of the metal plate, a patterning apparatus and a patterning method using the same.

Additional aspects of the disclosure will be set forth in part in the description which follows and, in part, will be obvious from the description, or may be learned by practice of the disclosure.

In accordance with one aspect of the present disclosure, a metal plate to be used in a household appliance includes a plurality of pattern portions, in which a hairline pattern is formed, on a surface of the metal plate, wherein the plurality of pattern portions includes a first pattern portion having a first hairline pattern and a second pattern portion having a second hairline pattern different from the first hairline pattern.

The plurality of pattern portions may have widths different from each other.

The first hairline pattern and the second hairline pattern may be formed in a first direction, and the first pattern portion and the second pattern portion may be arranged in a second direction perpendicular to the first direction.

The first pattern portion and the second pattern portion may be alternately arranged.

At least one of the plurality of pattern portions may be formed to be inclined.

The first pattern portion and the second pattern portion may be spaced apart from each other.

A plurality of first pattern portions and a plurality of second pattern portions may be provided, and an adjacent pair of the first pattern portion and the second pattern portion among the plurality of first pattern portions and the second pattern portions may be spaced apart from each other by a first distance, and another adjacent pair of the first pattern portion and the second pattern portion may be spaced apart from each other by a second distance different from the first distance.

The plurality of pattern portions may have textures different from each other.

The metal plate may include stainless steel.

The metal plate may be used for a door of a refrigerator.

In accordance with another aspect of the present disclosure, a patterning apparatus includes an abrasive device configured to form a pattern on a surface of a metal plate, wherein the abrasive device includes an abrasive belt base, an abrasive belt including a plurality of abrasive portions formed on the abrasive belt base, and an abrasive roller configured to rotate the abrasive belt, wherein the plurality of abrasive portions includes a first abrasive portion coated with a first abrasive material and a second abrasive portion coated with a second abrasive material different from the first abrasive material.

The first abrasive portion may include a first unit belt coated with the first abrasive material, and the first unit belt may be attached to the abrasive belt base.

The second abrasive portion may include a second unit belt coated with the second abrasive material, and the second unit belt may be attached to the abrasive belt base.

The first abrasive material and the second abrasive material may have particle sizes different from each other.

The plurality of abrasive portions may have widths different from each other.

At least one of the plurality of abrasive portions may be formed to be inclined.

The first abrasive portion and the second abrasive portion may be spaced apart from each other.

In accordance with still another aspect of the present disclosure, a patterning method of forming a pattern on a surface of a metal plate includes moving the metal plate and preparing an abrasive device including an abrasive belt having a first abrasive portion and a second abrasive portion coated with abrasive materials different from each other; disposing the metal plate and the abrasive belt so that the first abrasive portion and the second abrasive portion are in contact with the metal plate; and moving at least one of the metal plate and the abrasive belt and forming hairline patterns different from each other on the surface of the metal plate through grinding.

The patterning method may further include forming a plurality of patterns different from the hairline patterns on the surface of the metal plate.

The patterning method may further include forming an embossing pattern on the surface of the metal plate through rolling.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, exemplary embodiments of the present disclosure will be described in detail with reference to the accompanying drawings.

Figure 1:
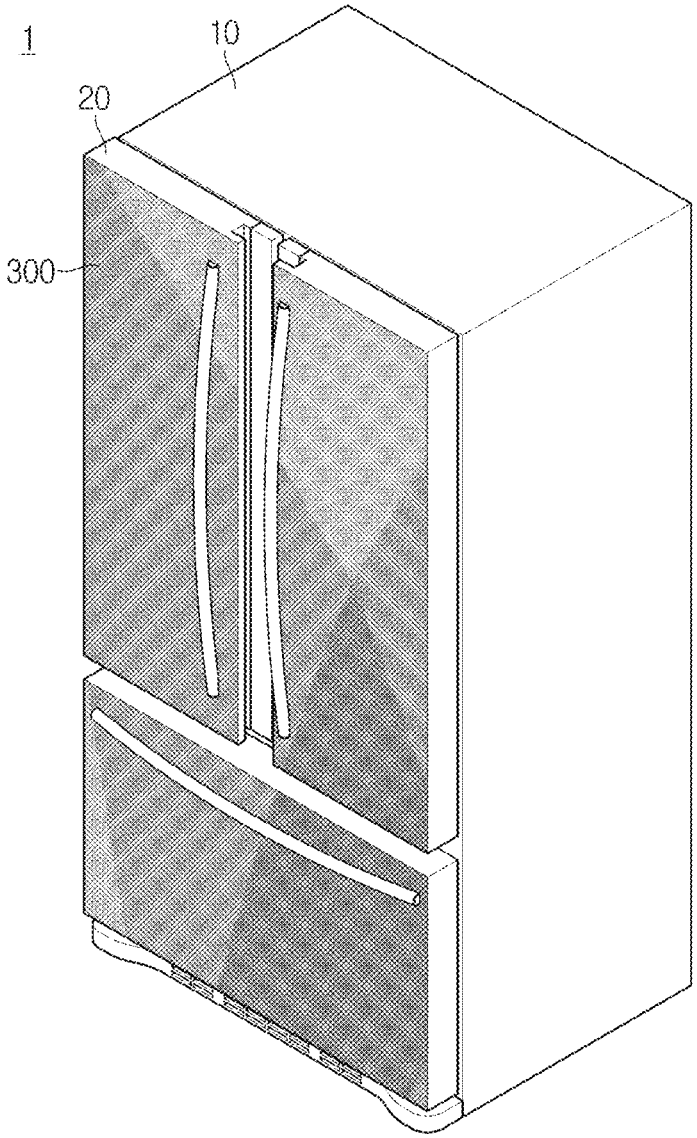
FIG. 1 is a perspective view of a refrigerator in which a metal plate according to the present disclosure can be used.

FIG. 1 is a perspective view of a refrigerator in which a metal plate according to the present disclosure can be used.

As illustrated in FIG. 1, a metal plate 100 according to the present disclosure may be used in household appliances. In particular, the metal plate 100 may be used in a refrigerator 1 of the household appliances. The metal plate 100 may form an exterior of the refrigerator 1 and may be used for a door 20 of the refrigerator 1.

The refrigerator 1 may include a main body 10 provided to form an exterior. The main body 10 may include an inner surface forming a storage chamber and an outer surface coupled to an outside of the inner surface to form the exterior of the refrigerator 1. The refrigerator 1 may include a heat insulating material foamed between the inner surface and the outer surface.

The refrigerator 1 may include the storage chamber formed inside the main body 10 so that food can be stored therein. Specifically, the storage chamber may be formed inside the inner surface. The refrigerator 1 may include a cool air supply device configured to supply cool air to the storage chamber to freshly keep the food stored in the storage chamber.

The cool air supply device may include a compressor configured to compress a refrigerant to a high pressure, a condenser configured to condense the compressed refrigerant, an expander configured to expand the refrigerant to a low pressure, an evaporator configured to generate the cool air by evaporating the refrigerant, and a refrigerant pipe configured to guide the refrigerant.

The refrigerator 1 may include a door 20 rotatably installed on the main body 10 to open and close an opened front surface of the storage chamber. Specifically, the door 20 may be hinge-coupled to the main body 10 to be rotatable. The door 20 may form the exterior of the refrigerator 1 together with the main body 10.

The refrigerator 1 is a household appliance configured to store food, and recently serves as an interior product, and thus design differentiation may be required as product competitiveness.

To this end, the metal plate 100 used for the door 20 of the refrigerator 1 may be formed of metal such as stainless steel to have specific gloss and texture and to make the exterior of the refrigerator 1 more advanced.

Stainless steel can be used not only in the metal plate 100 forming the exterior of the household appliance but also in windows and doors and interior facilities such as various window frames and inner walls in a building. Stainless steel is rust-free, thus requires no special maintenance and may be included in a metallic finishing material with high interior effects due to the specific gloss.

The metal plate 100 having a pattern on a surface thereof according to the present disclosure may include stainless steel. The metal plate 100 capable of being used for the door 20 of the refrigerator 1 according to the present disclosure may include a hairline pattern 300.

The hairline pattern 300 is a pattern processed so that fine patterns are formed on the surface of the metal plate 100, and a surface treatment of the hairline pattern 300 on the metal plate 100 may be performed by machining the fine patterns extending in a vertical direction (longitudinal direction) or a horizontal direction (transverse direction) on the surface.

That is, the hairline pattern 300 may be formed to extend in the vertical direction on the surface of the metal plate 100 or may be formed to extend in the horizontal direction. The hairline pattern 300 formed in the horizontal direction may have an effect in which an increase of luminance and diffuse reflection are offset.

Generally, when the hairline pattern 300 is formed on the surface of the metal plate 100 in the vertical direction, first, the metal plate 100 rolled to a predetermined thickness through a rolling process and prepared in the form of a coil may be continuously supplied.

An abrasive device 400 installed in series in a feeding direction of the continuously supplied metal plate 100 may continuously form the pattern on the surface of the metal plate 100 using an abrasive belt 410.

At this time, a grinding direction of the abrasive device 400 is in parallel with the feeding direction of the metal plate 100, and thus the hairline pattern 300 may be formed in the vertical direction which is the same as the feeding direction of the metal plate 100.

Alternatively, when the hairline pattern 300 is formed on the surface of the metal plate 100 in the horizontal direction, surface grinding through a continuous process may not be possible with a conventional abrasive device due to restriction in a specification of the rolled metal plate, unlike the case in which the hairline pattern 300 is formed in the vertical direction.

Figure 2:
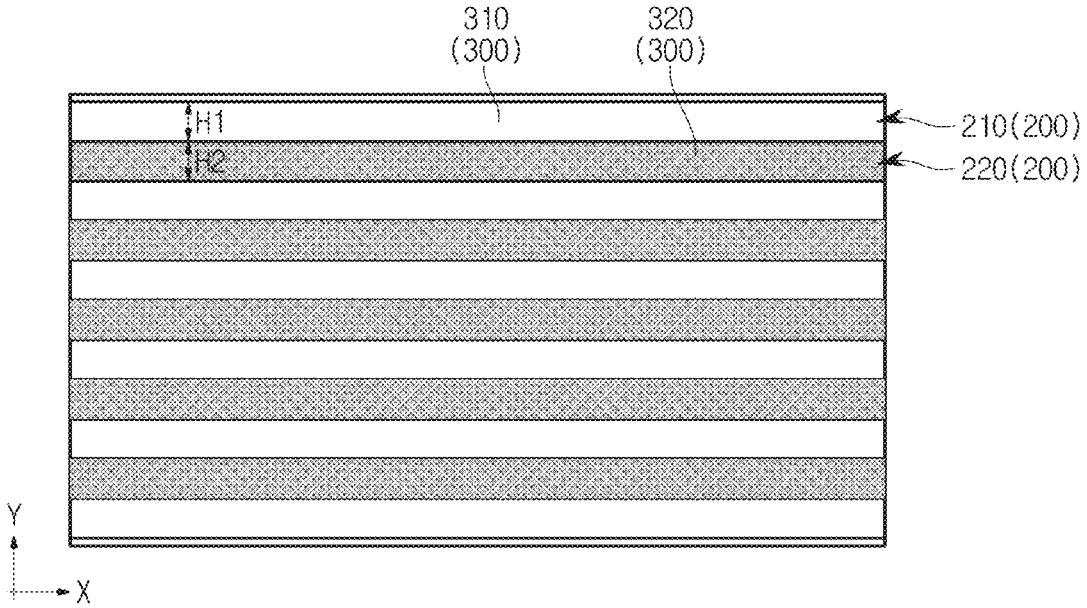
FIG. 2 is a view illustrating a hairline pattern formed on a surface of a metal plate according to a first embodiment of the present disclosure.

FIG. 2 is a view illustrating a hairline pattern formed on the surface of the metal plate according to a first embodiment of the present disclosure.

As illustrated in FIG. 2, the surface of the metal plate 100 capable of being used in the household appliances according to the first embodiment of the present disclosure may include a plurality of pattern portions 200 on which the hairline pattern 300 is formed.

The plurality of pattern portions 200 may include a first pattern portion 210 and a second pattern portion 220. The hairline pattern 300 may include a first hairline pattern 310 and a second hairline pattern 320.

The first hairline pattern 310 and the second hairline pattern 320 may be formed in a first direction, and the first pattern portion 210 and the second pattern portion 220 may be disposed in a second direction perpendicular to the first direction.

As illustrated in FIG. 2, when the first direction is formed in the horizontal direction (X-axis direction), the second direction may be formed in the vertical direction (Y-axis direction). On the contrary to this, when the first direction is formed in the vertical direction (Y-axis direction), the second direction may be formed in the horizontal direction (X-axis direction).

Therefore, FIG. 2 illustrates a case in which the hairline pattern 300 is formed in the horizontal direction (X-axis direction) and the plurality of pattern portions 200 are arranged in the vertical direction (Y-axis direction), but the present disclosure is not limited thereto.

Conversely, the hairline pattern 300 may be formed in the vertical direction (Y-axis direction) and the plurality of pattern portions 200 may be arranged in the horizontal direction (X-axis direction). That is, the hairline pattern 300 formed on the surface of the metal plate 100 according to the present disclosure may be formed in both of the horizontal direction and the vertical direction.

The plurality of pattern portions 200 may include the first pattern portion 210 having the first hairline pattern 310 and the second pattern portion 220 having the second hairline pattern 320 different from the first hairline pattern 310.

That is, the first pattern portion 210 and the second pattern portion 220 may have different textures. Accordingly, it is possible to overcome monotony of the hairline pattern 300 formed on the surface of the metal plate 100 and to enhance overall aesthetic feeling.

The textures of the plurality of pattern portions 200 may be determined according to a particle size of an abrasive material 450 attached to a plurality of abrasive portions 440 of the abrasive belt 410 forming the hairline pattern 300. A detailed description of the particle size of the abrasive material 450 will be given below.

Each of the plurality of pattern portions 200 may have a predetermined width H. The first pattern portion 210 may have the first width H1 and the second pattern portion 220 may have a second width H2. The first width H1 and the second width H2 may be the same as each other.

A plurality of first pattern portions 210 and a plurality of second pattern portions 220 may be provided. The plurality of first pattern portions 210 and the plurality of second pattern portions 220 may be alternately arranged. Thus, the monotony of the hairline pattern 300 can be overcome.

Figure 3:
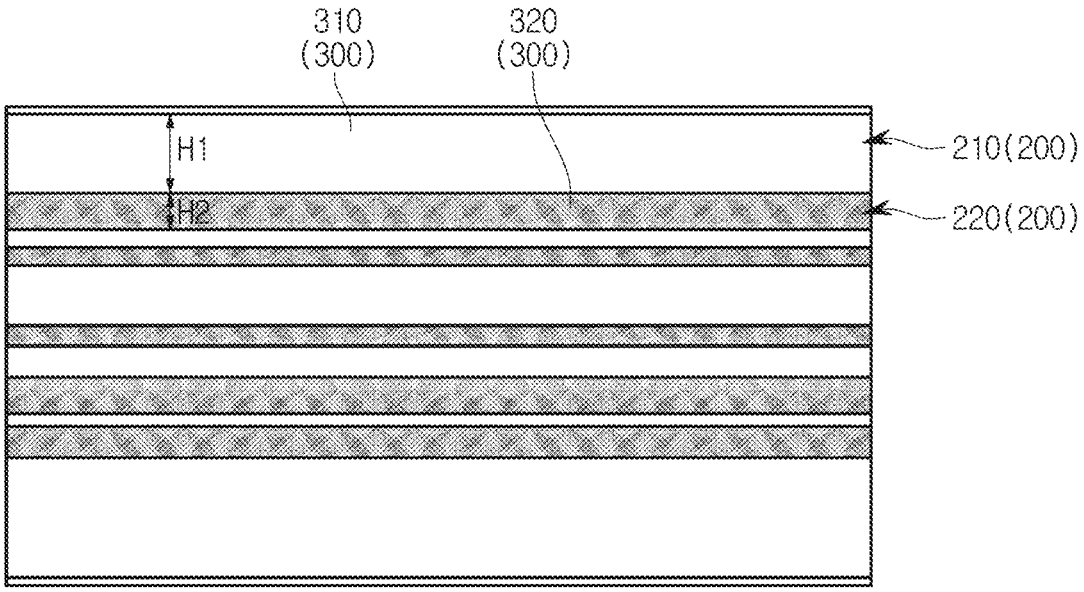
FIG. 3 is a view illustrating a hairline pattern formed on a surface of a metal plate according to a second embodiment of the present disclosure.

FIG. 3 is a view illustrating a hairline pattern formed on the surface of the metal plate according to a second embodiment of the present disclosure.

As illustrated in FIG. 3, the hairline pattern 300 formed on the surface of the metal plate 100 according to the second embodiment may be generally the same as the hairline pattern 300 formed on the surface of the metal plate 100 according to the first embodiment, and the predetermined widths H of the plurality of pattern portions 200 may be different from each other.

That is, the predetermined widths H of the plurality of pattern portions 200 may be different from each other. The first width H1 of the first pattern portion 210 and the second width H2 of the second pattern portion 220 may be different from each other.

A plurality of first pattern portions 210 may be provided, and the first widths H1 of the plurality of first pattern portions 210 may be different from each other. A plurality of second pattern portions 220 may be provided, and the second widths H2 of the plurality of second pattern portions 220 may be different from each other.

Figure 4:
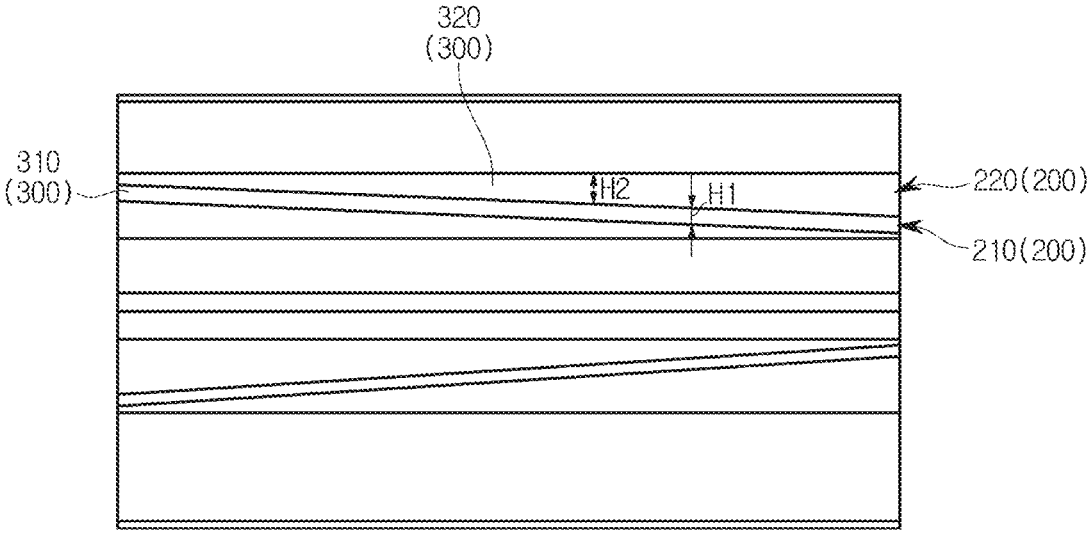
FIG. 4 is a view illustrating a hairline pattern formed on a surface of a metal plate according to a third embodiment of the present disclosure.

FIG. 4 is a view illustrating a hairline pattern formed on the surface of the metal plate according to a third embodiment of the present disclosure.

As illustrated in FIG. 4, the hairline pattern 300 formed on the surface of the metal plate 100 according to the third embodiment may be generally the same as the hairline pattern 300 formed on the surface of the metal plate 100 according to the second embodiment, and at least one of the plurality of pattern portions 200 may be formed to be inclined.

The first pattern portion 210 of the plurality of pattern portions 200 may be formed to be inclined. When the first pattern portion 210 is formed to be inclined, the first width H1 of the first pattern portion 210 may be uniform, but the second width H2 of the second pattern portion 220 may not be constant.

FIG. 4 illustrates a case in which the first pattern portion 210 is formed to be inclined, but the present disclosure is not limited thereto. The second pattern portion 220 may be formed to be inclined or both of the first pattern portion 210 and the second pattern portion 220 may be formed to be inclined.

Figure 5:
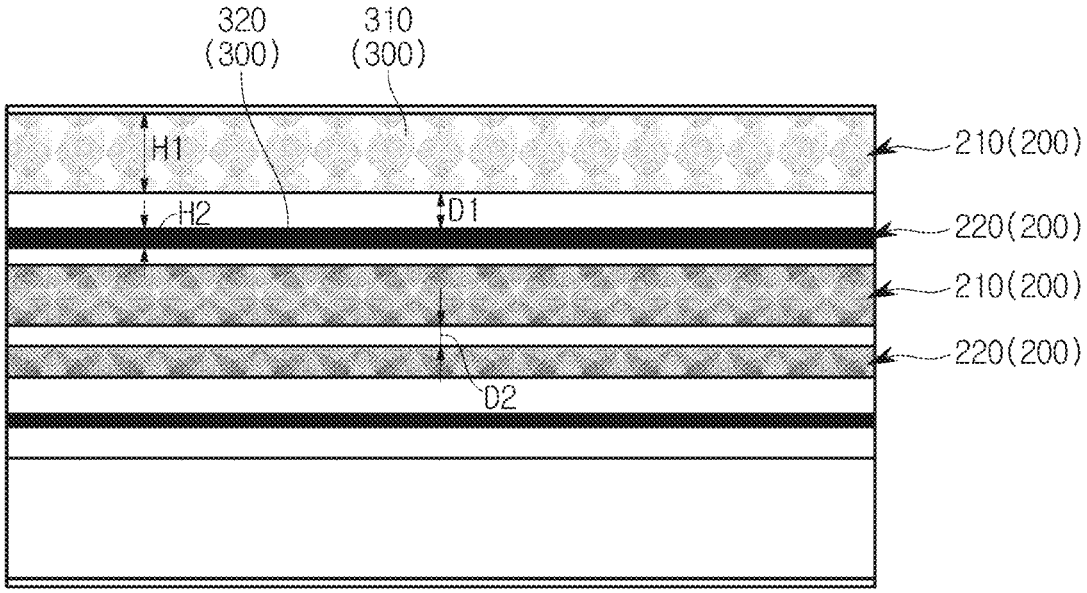
FIG. 5 is a view illustrating a hairline pattern formed on a surface of a metal plate according to a fourth embodiment of the present disclosure.

FIG. 5 is a view illustrating a hairline pattern formed on the surface of the metal plate according to a fourth embodiment of the present disclosure.

As illustrated in FIG. 5, a plurality of first pattern portions 210 and a plurality of second pattern portions 220 according to the fourth embodiment of the present disclosure may be provided, the plurality of first pattern portions 210 may have textures different from each other, and the plurality of second pattern portions 220 may have textures different from each other.

Accordingly, it is possible to overcome the monotony of the hairline pattern 300 formed on the surface of the metal plate 100 and to enhance the overall aesthetic feeling.

The textures of the plurality of first pattern portions 210 and second pattern portions 220 may be determined according to a particle size of the abrasive material 450 attached to the plurality of abrasive portions 440 of the abrasive belt 410 forming the hairline pattern 300. A detailed description of the particle size of the abrasive material 450 will be given below.

The first pattern portions 210 and the second pattern portions 220 may be spaced apart from each other. The plurality of first pattern portions 210 and the second pattern portions 220 may have separation distances D. The separation distances D may be the same as each other.

An adjacent pair of the first pattern portion 210 and the second pattern portion 220 among the plurality of first pattern portions 210 and the second pattern portions 220 may be spaced apart from each other by a first distance D1, and another adjacent pair of the first pattern portion 210 and the second pattern portion 220 may be spaced apart from each other by a second distance D2. The first distance D1 and the second distance D2 may be different from each other.

Figure 6:
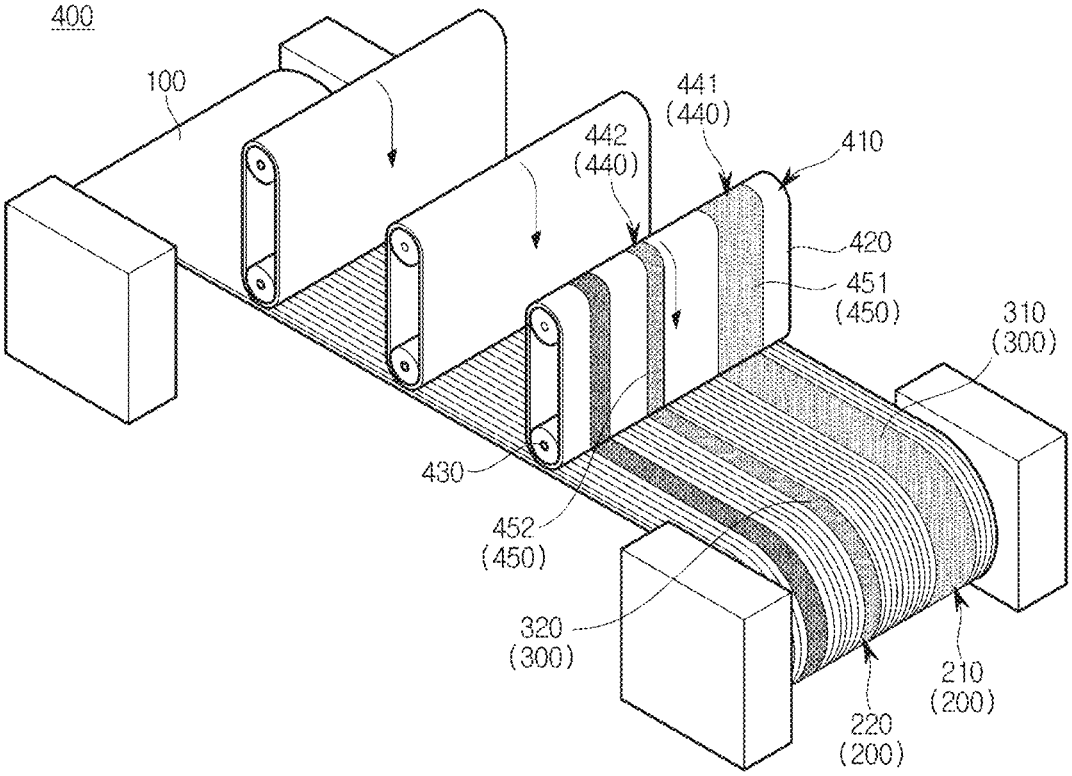
FIG. 6 is a schematic perspective view of an abrasive device included in a patterning apparatus according to the present disclosure.

FIG. 6 is a schematic perspective view of the abrasive device included in a patterning apparatus according to the present disclosure.

The patterning apparatus according to the present disclosure may include the abrasive device 400 configured to form the hairline pattern 300 on the surface of the metal plate 100.

The abrasive device 400 may include an abrasive belt base 420, the abrasive belt 410 including the plurality of abrasive portions 440 formed on the abrasive belt base 420, and an abrasive roller 430 configured to rotate the abrasive belt 410.

The abrasive belt 410 may be located above the metal plate 100 moved by a support roll (not illustrated), and the abrasive roller 430 may include a tension roll and a contact roll. The abrasive belt 410 may be provided to be wound around the abrasive roller 430 including the tension roll and the contact roll.

The abrasive belt 410 may be rotated by driving the contact roll, and the contact roll may be indirectly rotated by a driving device (not illustrated) configured to drive the support roll (not illustrated) and may also be directly rotated by a separate driving device (not illustrated).

The contact roll may be rotated in both directions by the driving device (not illustrated). That is, the contact roll may be rotated in a normal direction which is a transfer direction of the metal plate 100 or in the transfer direction of the metal plate 100 by the driving device (not illustrated) according to a surface treatment method of the metal plate 100 and may be rotated in a reverse direction opposite to the normal direction.

The support roll (not illustrated) configured to move the metal plate 100 may be provided in the abrasive device 400. The support roll (not illustrated) configured to support a lower surface of the metal plate 100 may be provided below the metal plate 100 facing the abrasive belt 410.

The support roll (not illustrated) may be rotated by the driving device (not illustrated) configured to drive the support roll (not illustrated) to be in contact with or spaced from the lower surface of the metal plate 100.

The plurality of abrasive portions 440 included in the abrasive belt 410 may be formed by being coated with the abrasive material 450. The abrasive material 450 may include a material used for grinding, polishing and blasting (for blowing).

The abrasive material 450 may include a natural abrasive and an artificial abrasive. The natural abrasive may include emery, corundum, garnet, sand, flint and so on, and the artificial abrasive may include silicon carbide, fused alumina and so on.

Meanwhile, the abrasive material 450 may include diamond or cubic boron nitride (cBN) or may be provided in the form of a mixture of the diamond or cubic boron nitride (cBN) and a bonding material formed of metal, resin or ceramic powder.

Generally, the abrasive material 450 applied to the plurality of abrasive portions 440 included in the abrasive belt 410 may include sand particles. The plurality of abrasive portions 440 may implement various hairline patterns 300 according to type of the particles of the abrasive material 450.

An electromagnetic field may be used to coat the plurality of abrasive portions 440 with the abrasive material 450.

The plurality of abrasive portions 440 may include a first abrasive portion 441 and a second abrasive portion 442, and the abrasive material 450 may include a first abrasive material 451 and a second abrasive material 452. The plurality of abrasive portions 440 may include a first abrasive portion 441 coated with the first abrasive material 451 and a second abrasive portion 442 coated with the second abrasive material 452.

The first abrasive material 451 and the second abrasive material 452 may be different from each other. That is, the plurality of abrasive portions 440 may have different particle sizes from each other. The particle size indicates a size of a sand particle capable of being used as the abrasive material 450 and may be generally divided by a size of an opening of a sieve (mesh).

In Korea, a nominal size (μ) of a standard sieve specified in the Korean industrial standards may be indicated as a unit of the particle size, and a mesh indicating the number of sieves may also be used.

The plurality of abrasive portions 440 may correspond to the plurality of pattern portions 200 to include the first pattern portion 210 in which the first hairline pattern 310 is formed on the surface of the metal plate 100 by the first abrasive portion 441 and the second pattern portion 220 in which the second hairline pattern 320 is formed on the surface of the metal plate 100 by the second abrasive portion 442.

That is, a plurality of first abrasive portions 441 and a plurality of second abrasive portions 442 may be provided, and the plurality of first abrasive portions 441 may have particle sizes different from each other, and the plurality of second abrasive portions 442 may also have particle sizes different from each other.

The first abrasive portion 441 and the second abrasive portion 442 may be spaced apart from each other. That is, the plurality of first abrasive portions 441 and the plurality of second abrasive portions 442 may have the same separation distances.

An adjacent pair of the first abrasive portion 441 and the second abrasive portion 442 among the plurality of first abrasive portions 441 and the plurality of second abrasive portions 442 may be spaced apart from each other by a separation distance different from that between another adjacent pair of the first abrasive portion 441 and the second abrasive portion 442.

The plurality of first abrasive portions 441 and the plurality of the second abrasive portions 442 may be alternately arranged. The plurality of abrasive portions 440 may have predetermined widths. The predetermined widths of the plurality of abrasive portions 440 may be different from each other.

That is, the first abrasive portion 441 and the second abrasive portion 442 may have different widths. The plurality of first abrasive portions 441 may be provided, and the widths of the plurality of first abrasive portions 441 may be different from each other. The plurality of second abrasive portions 442 may be provided, and the widths of the plurality of second abrasive portions 442 may be different from each other.

The plurality of abrasive portions 440 may be formed to be inclined. The first abrasive portions 441 may be formed to be inclined. When the first abrasive portions 441 are formed to be inclined, widths of the first abrasive portions 441 may be constant, but widths of the second abrasive portions 442 may not be constant. Further, the second abrasive portions 442 may be formed to be inclined, and all of the first abrasive portions 441 and the second abrasive portions 442 may be formed to be inclined.

Figure 7:
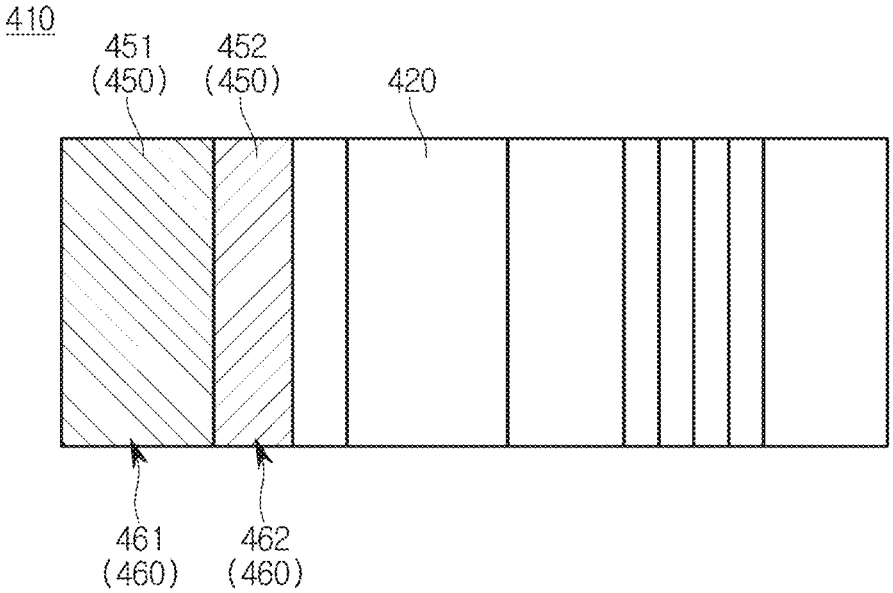
FIG. 7 is a schematic cross-sectional view of an abrasive belt included in the abrasive device in the patterning apparatus according to the present disclosure.

FIG. 7 is a schematic cross-sectional view of the abrasive belt included in the abrasive device in the patterning apparatus according to the present disclosure.

As illustrated in FIG. 7, the abrasive belt 410 may include the plurality of abrasive portions 440 coated with the abrasive material 450.

Generally, the abrasive belt 410 may be used by attaching the abrasive material 450 to the entire abrasive belt base 420 using an electromagnetic field and then cutting the abrasive material 450 to a certain width and length as required.

The abrasive belt 410 may be formed by joining together both ends of the abrasive belt base 420 having the plurality of abrasive portions 440 formed thereon in an annular shape or by weaving the abrasive belt base 420 into a bag shape without a joint.

The abrasive belt 410 according to the present disclosure may be manufactured by a selectively coating method of the abrasive material 450 and a method of attaching a plurality of unit belts 460.

In the abrasive belt 410 manufactured by the selectively coating method of the abrasive material 450, the plurality of abrasive portions 440 may be formed by coating only necessary portions of the abrasive belt base 420 with an adhesive agent and then applying the abrasive material 450 using electro-deposition or gravity.

Meanwhile, in the abrasive belt 410 manufactured by the method of attaching the plurality of unit belts 460, the entire abrasive belt 410 manufactured by the coating method of the abrasive material 450 may be formed into the plurality of unit belts 460 through slitting or cutting.

The plurality of abrasive portions 440 may be formed by attaching the plurality of formed unit belts 460 to only the necessary portions of the abrasive belt base 420.

The abrasive belt base 420 may include Kraft paper, a cloth fiber combination, a film, a non-woven fabric, and so on.

The plurality of unit belts 460 may include a first unit belt 461 and a second unit belt 462. The first abrasive portion 441 may include a first unit belt 461 coated with the first abrasive material 451, and the first unit belt 461 may be attached to the abrasive belt base 420 and may form the first abrasive portion 441.

The second abrasive portion 442 may include a second unit belt 462 coated with the second abrasive material 452, and the second unit belt 462 may be attached to the abrasive belt base 420 and may form the second abrasive portion 442.

That is, in the abrasive belt 410, the various hairline patterns 300 may be formed on the surface of the metal plate 100 by processing the abrasive belt 410 to include the abrasive material 450 having a desired particle size and the plurality of abrasive portions 440 having a desired width.

Figure 8:
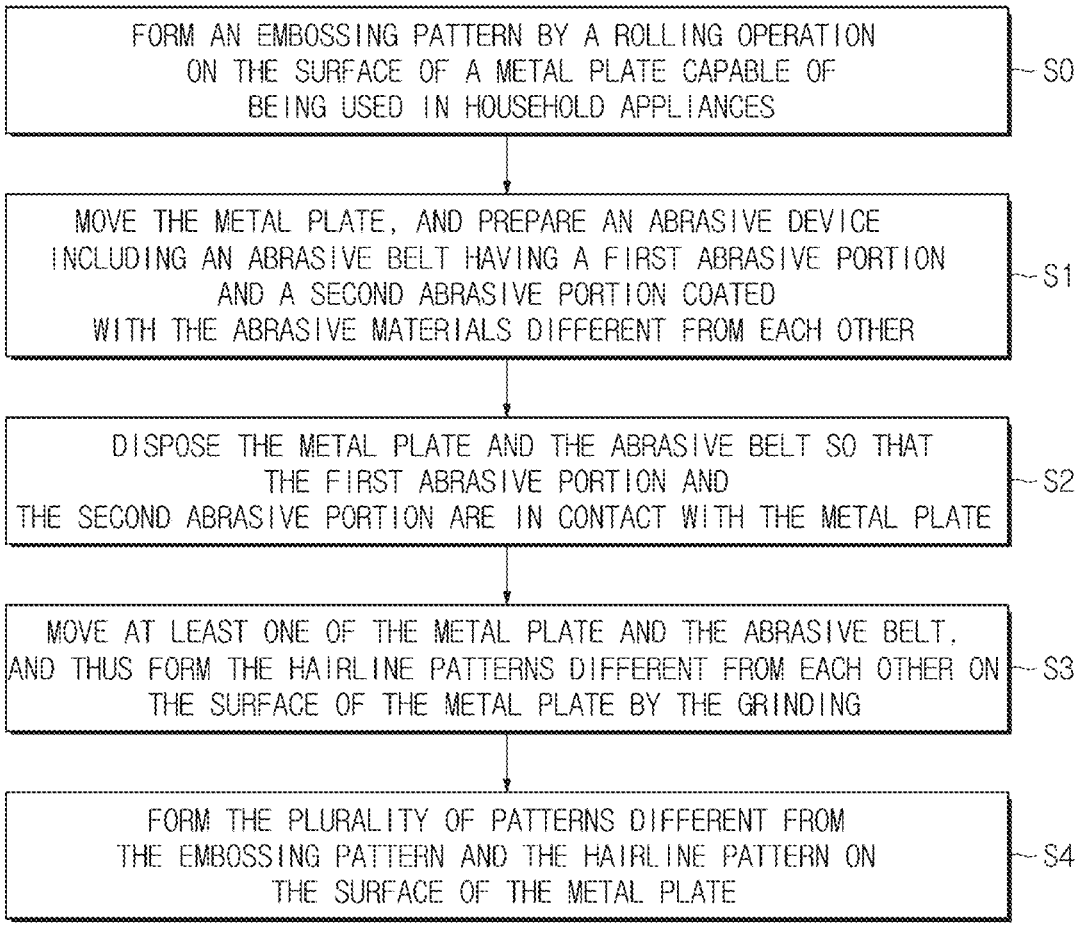
FIG. 8 is a block diagram illustrating a process in which a plurality of patterns are formed on a surface of a metal plate in a patterning method according to the present disclosure.

FIG. 8 is a block diagram illustrating a process in which a plurality of patterns are formed on the surface of the metal plate in a patterning method according to the present disclosure.

A method of forming the hairline pattern 300 and a plurality of various patterns other than the hairline pattern 300 will be described with reference to FIG. 8.

Generally, in the metal plate 100, defects formed on the surface thereof may be removed through a cold rolling process. Such methods of removing the defects may include a chemical method and a mechanical method, and the grinding using the abrasive belt 410 may be included in one of the mechanical methods.

In a patterning method configured to form a pattern on the surface of the metal plate 100, first, the metal plate 100 may be moved for a process.

Then, the abrasive device 400 including the abrasive belt 410 having the first abrasive portion 441 and the second abrasive portion 442 coated with the abrasive materials 450 different from each other is prepared, and the metal plate 100 and the abrasive belt 410 may be disposed so that the first abrasive portion 441 and the second abrasive portion 442 are in contact with the metal plate 100.

At least one of the metal plate 100 and the abrasive belt 410 may be moved through a driving device and a roller, and thus the hairline patterns 300 different from each other may be formed on the surface of the metal plate 100 by the grinding.

That is, in the abrasive device 400 forming the hairline pattern 300, the abrasive roller 430 may be rotated by the driving device, and thus the abrasive belt 410 wound around the abrasive roller 430 may be rotated at a high speed.

In this process, the surface of the metal plate 100 moving from an uncoiler to a coiler may be ground by the abrasive belt 410. The patterning method configured to form the hairline pattern 300 can employ a continuous roll-to-roll surface treatment method.

If necessary, the optimum hairline pattern 300 may be formed by adjusting an RPM of the driving device configured to drive the abrasive roller 430 of the abrasive belt 410 and a speed of the driving device configured to drive the support roll moving the metal plate 100.

The patterning apparatus according to the present disclosure may form the hairline pattern 300 having textures different from each other on the plurality of pattern portions 200 in a single process by the abrasive belt 410 including the plurality of abrasive portions 440 having different particle sizes.

Accordingly, it is possible to overcome the monotony of the hairline pattern 300 formed on the surface of the metal plate 100 and to enhance the overall aesthetic feeling.

Meanwhile, the patterning method according to the present disclosure may further include forming the hairline pattern 300 and the plurality of patterns different from the hairline pattern 300 on the surface of the metal plate 100.

Generally, in the hairline pattern 300 formed on the surface of the metal plate 100, it may be difficult to recognize a specific design of the hairline pattern 300 unless eyes are brought close to the surface of the metal plate 100.

Therefore, the plurality of various patterns other than the hairline pattern 300 may be formed on the surface of the metal plate 100, on which the hairline pattern 300 is formed, to have various interior effects.

By the hairline pattern 300 and the plurality of various patterns, it is possible to maximize the aesthetic effect of the metal plate 100 capable of being used for the exteriors of the various household appliances.

A type of the process in which the plurality of various patterns other than the hairline pattern 300 are formed may include a No. 4 process in which a gloss of the surface of the metal plate 100 is finely finished, a BA process in which a gloss like a mirror surface is formed, an embossing process in which finishing is performed to have irregularities, and an etching process in which a pattern by a chemical treatment is provided.

Further, a bead/sand blast process in which glass/sand particles are sprayed to form a haze effect on the surface of the metal plate 100, and a vibration process in which a non-directional concentric circle pattern is formed, a silk printing process in various patterns are realized through printing, and so on may be included.

In addition to the hairline process in which the hairline pattern 300 is formed on the surface of the metal plate 100, a typical patterning process may include the embossing process and the etching process.

The etching process is a patterning method in which the metal plate 100 is chemically processed after completion of press forming. First, a separately designed pattern may be formed into a film on the surface of the metal plate 100 on which the hairline pattern 300 is formed, and the film may be exposed to a silk membrane.

A process in which the pattern exposed to the silk membrane through the film is coated with ink and ferric chloride (FeCl) is sprayed thereon to perform a selective corroding operation and thus a decorative effect is provided may be included.

Figure 9:
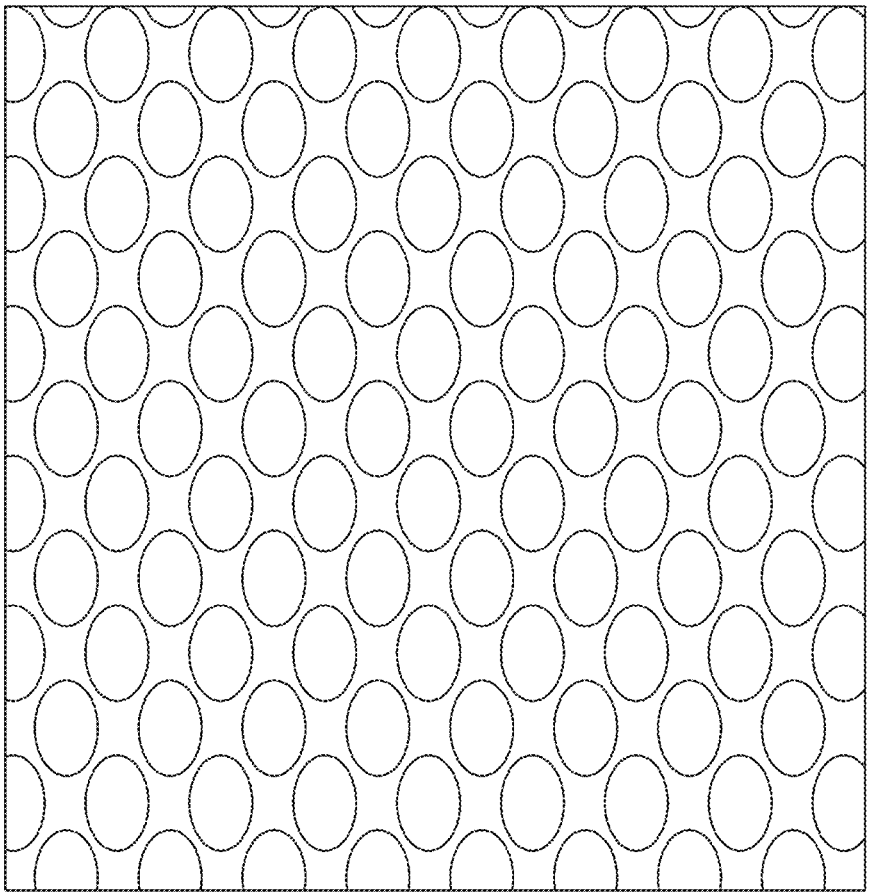
FIG. 9 is a view illustrating an embossing pattern formed on the surface of the metal plate in the patterning method according to the present disclosure.

FIG. 9 is a view illustrating the embossing pattern formed on the surface of the metal plate in the patterning method according to the present disclosure.

As illustrated in FIG. 9, the patterning method configured to form the pattern on the surface of the metal plate 100 according to the present disclosure may further include forming an embossing pattern by a rolling operation on the surface of the metal plate 100 in addition to the hairline pattern 300.

The embossing process in which an embossing pattern 500 is formed on the surface of the metal plate 100 is one of stamping methods and may include a process in which various shapes are stamped by a pair of upper and lower dies having irregularities opposite to each other or by performing the rolling on the metal plate 100 with a rolling roller.

The embossing process may be mainly used when a pattern, a letter, a reinforcing rib, or the like is embossed in the metal plate 100.

In the present disclosure, by forming the various hairline patterns on the surface of the metal plate in a single process, it is possible to maximize the aesthetic effect, and the continuous process of forming the plurality of patterns can be simplified.

In the present disclosure, by forming the plurality of various patterns other than the hairline pattern, it is possible to overcome the monotony of the hairline pattern caused by repeated simple straight lines and to enhance the interior value of the metal plate capable of being used in the household appliances.

Although the technical idea of the present disclosure has been described above with reference to the specific embodiments, the scope of the present disclosure is not limited to these embodiments. It would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A patterning apparatus comprising:

an abrasive device configured to form a pattern on a surface of a metal plate, wherein the abrasive device includes an abrasive belt base, an abrasive belt including a plurality of abrasive portions formed on the abrasive belt base, and an abrasive roller configured to rotate the abrasive belt, wherein the plurality of abrasive portions includes a first abrasive portion coated with a first abrasive material and a second abrasive portion coated with a second abrasive material different from the first abrasive material, and wherein the plurality of abrasive portions have widths different from each other.

2. The patterning apparatus according to claim 1, wherein the first abrasive portion includes a first unit belt coated with the first abrasive material, and the first unit belt is attached to the abrasive belt base.

3. The patterning apparatus according to claim 2, wherein the second abrasive portion includes a second unit belt coated with the second abrasive material, and the second unit belt is attached to the abrasive belt base.

4. The patterning apparatus according to claim 1, wherein the first abrasive material and the second abrasive material have particle sizes different from each other.

5. The patterning apparatus according to claim 1, wherein at least one of the plurality of abrasive portions is formed to be inclined.

6. The patterning apparatus according to claim 1, wherein the first abrasive portion and the second abrasive portion are spaced apart from each other.

7. A patterning method of forming a pattern on a surface of a metal plate, the method comprising:

forming an embossing pattern on the surface of the metal plate through rolling;

moving the metal plate and preparing an abrasive device including an abrasive belt having a first abrasive portion and a second abrasive portion coated with abrasive materials different from each other;

disposing the metal plate and the abrasive belt so that the first abrasive portion and the second abrasive portion are in contact with the metal plate; and moving at least one of the metal plate and the abrasive belt and forming hairline patterns different from each other on the surface of the metal plate through grinding.

8. The patterning method according to claim 7, further comprising forming a plurality of patterns different from the hairline patterns on the surface of the metal plate.

* * * * *